US008050593B2

(12) United States Patent
Furuichi et al.

(10) Patent No.: US 8,050,593 B2
(45) Date of Patent: Nov. 1, 2011

(54) IMAGE FORMING APPARATUS INCLUDING A MECHANISM FOR RELIABLY MOUNTING A PROCESS UNIT

(75) Inventors: Yuusuke Furuichi, Osaka (JP); Nobuhiko Kita, Osaka (JP); Sei Onuma, Osaka (JP); Ryoh Idehara, Hyogo (JP); Kazuyoshi Kondo, Osaka (JP); Genta Hagiwara, Tokyo (JP); Kaoru Tada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 401 days.

(21) Appl. No.: 12/118,989

(22) Filed: May 12, 2008

(65) Prior Publication Data

US 2008/0292356 A1 Nov. 27, 2008

(30) Foreign Application Priority Data

May 24, 2007 (JP) ..... 2007-138365

(51) Int. Cl.
*G03G 21/18* (2006.01)

(52) U.S. Cl. ..... 399/112; 399/110; 399/223

(58) Field of Classification Search ..... 399/112, 399/110, 223
See application file for complete search history.

(56) References Cited

U.S. PATENT DOCUMENTS

| | | | | |
|---|---|---|---|---|
| D322,279 | S | 12/1991 | Tsutsui | |
| D365,845 | S | 1/1996 | Yasuda et al. | |
| 6,978,102 | B2 * | 12/2005 | Okamura et al. | 399/110 |
| 2004/0022556 | A1 * | 2/2004 | Nomura | 399/116 |
| 2004/0052538 | A1 * | 3/2004 | Yugeta et al. | 399/27 |
| 2007/0110473 | A1 | 5/2007 | Kondo et al. | |
| 2007/0110475 | A1 | 5/2007 | Idehara et al. | |
| 2007/0166073 | A1 | 7/2007 | Idehara et al. | |
| 2007/0189781 | A1 * | 8/2007 | Katogi et al. | 399/12 |
| 2007/0246638 | A1 | 10/2007 | Idehara et al. | |

FOREIGN PATENT DOCUMENTS

| | | |
|---|---|---|
| JP | 9-212066 | 8/1997 |
| JP | 3614078 | 11/2004 |
| JP | 2005-43584 | 2/2005 |
| JP | 2006-72290 | 3/2006 |
| JP | 2006-184436 | 7/2006 |
| JP | 2007-79061 | 3/2007 |
| JP | 2007-140041 | 6/2007 |
| JP | 2007-164128 | 6/2007 |
| JP | 2007-164141 | 6/2007 |
| JP | 2007-192894 | 8/2007 |
| JP | 2007-293251 | 11/2007 |

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus capable of reliably positioning a process unit in a main image forming apparatus body, without impairing ease of mounting/dismounting of the process unit achieved by a simple structure. The image forming apparatus including a convex section, provided on the process unit, that projects towards the insertion side; an engagement section, provided on the main apparatus body, that positions the process unit in a width direction by engaging with the convex section; and a guidance section, provided on at least one of a tip end of the convex section and the main apparatus body, that guides the convex section towards the guidance section when mounting the process unit.

12 Claims, 12 Drawing Sheets

FIG. 13

| | WIDTH DIMENSION S | WIDTH DIMENSION T | WIDTH DIMENSION U | WIDTH DIMENSION V |
|---|---|---|---|---|
| PROCESS UNIT A1 | 2 | 4 | 2.5 | 3 |
| PROCESS UNIT A2 | 5 | 4 | 5.5 | 3 |
| PROCESS UNIT A3 | 8 | 4 | 8.5 | 3 |
| PROCESS UNIT A4 | 11 | 4 | 11.5 | 3 |

IMAGE FORMING APPARATUS INCLUDING A MECHANISM FOR RELIABLY MOUNTING A PROCESS UNIT

BACKGROUND OF THE INVENTION

1. Field of the Invention

The present invention relates to an image forming apparatus and to a process unit that is detachably provided to this image forming apparatus.

2. Description of the Related Art

In image forming apparatus, such as a copier, printer, facsimile machine, or apparatus combining these, the process unit system may be adopted, in which cases in which are accommodated process means such as an image carrier, charging unit, developing device or toner accommodating unit are detachably provided with respect to the main body of the image forming apparatus. In this system, the user can easily replace these process units when maintenance of these process units is required.

Consequently, in such a process unit system, a mechanism for mounting/detaching of these process units with respect to the main body of the image forming apparatus is provided. However, there were the problems that ease of mounting/detachment by the conventional mounting/detachment mechanism and/or the precision of positional location thereof with respect to the main body of the image forming apparatus were low.

Technologies relating to the present invention are disclosed in, e.g., Laid-open Japanese Patent Application No. 2001-272838.

SUMMARY OF THE INVENTION

It is an object of the present invention to provide an image forming apparatus and process unit with a simple structure whereby positional location thereof with respect to the main body of the image forming apparatus can be reliably performed without impairing ease of mounting/dismounting the process unit.

The gist of the present invention, which solves the aforementioned problems of the prior art, is described below.

(1) According to the present invention, in an image forming apparatus in which a process unit having at least one of an image carrier, a charging unit, a developing device and a toner accommodating unit is detachably mounted, in a direction orthogonal to a width direction of the process unit, to a main apparatus body of the image forming apparatus wherein the improvement comprises: a convex section that projects towards an insertion side provided on the process unit; an engagement section that positions the process unit in the width direction by engaging with the convex section in a condition where the process unit is mounted, provided in the main apparatus body; and a guidance section that guides the convex section towards the engagement section, when the process unit is mounted, provided on at least one of a tip end of the convex section and the main apparatus body.

The "width direction of the process unit" includes for example the longitudinal direction of the process unit or the axial direction of a member accommodated in the process unit, but also includes arbitrarily determined directions other than these. When the process unit is mounted in the main apparatus body, the process unit is inserted into the main apparatus body with the convex section of the process unit directed towards the insertion side. As the process unit is inserted, the convex section comes into contact with the main apparatus body and is guided towards the engagement section by the guidance section. The process unit is therefore located in position in the width direction thereof by engagement of the convex section and the engagement section.

(2) In this image forming apparatus, the guidance section may be inclined in the width direction. The convex section can be guided in the width direction by this guidance section.

(3) In this image forming apparatus, a straight section extending in the insertion direction may be provided on at least one of the locations where the convex section and engagement section come into mutual contact. In this way, reliable engagement of the convex section and engagement section can be achieved, so the process unit can be precisely located in position in the width direction, and subsequent positional offset thereof in the width direction can be prevented.

(4) Likewise, in an image forming apparatus, a pair of side plates facing each other with a gap corresponding to the width direction of the process unit are arranged in the main apparatus body, the process unit being detachably mounted between this pair of side plates, and electrodes that are capable of mutual contact are arranged in one side face of the process unit and in the side plate corresponding to this side face, and a guidance section provided in the main apparatus body is inclined to the side plate side where the electrodes are provided. By means of a guidance section that is inclined in this way, the convex section can be guided towards the side plate side where the electrodes are provided. In this way, the electrodes that are respectively arranged adjacent thereon can be brought into contact by bringing one side face of the process unit adjacent to the corresponding side plate.

(5) In this image forming apparatus, the guidance section may be provided on the convex section and this guidance section may be inclined to the side plate side where the electrodes are provided. By means of a guidance section that is inclined in this way, the convex section can be guided towards the side plate side where the electrodes are provided. In this way, the electrodes that are respectively arranged adjacent thereon can be brought into contact by bringing one side face of the process unit adjacent to the corresponding side plate.

(6) In this image forming apparatus, the electrodes provided on the side plate may be arranged to be capable of resilient biasing in the inwards direction of this side plate. By resiliently biasing the electrodes of the side plate inwards when the respectively provided electrodes come into contact as the process unit approaches the corresponding side plate, mutual contact between the electrodes can be reliably performed.

(7) In this image forming apparatus, a process unit having an image carrier that is exposed to the outside may be erected in a condition placed on a placement surface with the exposed section of this image carrier directed downwards, two or more feet being provided so that the image carrier does not interfere with the placement surface, at least one of these feet serving as the convex section. Consequently, since the feet also play the role of the convex section for positional location of the process unit, there is no need to provide a separate convex section, thereby simplifying the construction and reducing manufacturing costs.

(8) In this image forming apparatus, comprising a plurality of process units that accommodate toners of different colors, an interference section may be provided whereby interference of the process unit and the main apparatus body occurs if an attempt is made to insert the process units in a position other than the prescribed mounting position. In this way, mounting of the process units in the wrong positions can be prevented, so there is no need to provide separate means for preventing wrong mounting, thereby simplifying the construction and reducing manufacturing costs.

(9) In the present invention, in a process unit which has a case that accommodates at least one of an image carrier, a charging unit, a developing device and a toner accommodating unit, and which is capable of detachably mounting this case, in a direction orthogonal to a width direction of the case, to a main apparatus body of an image forming apparatus, a convex section that projects towards an insertion side is provided on the case, an engagement section is provided, in the main apparatus body, that positions the case in the width direction by engaging with the convex section in a condition where the case is mounted, and a guidance section that guides the convex section towards the engagement section when mounting of the case is provided on at least one of a tip end of the convex section and the main apparatus body.

When the process unit is mounted in the main apparatus body, the process unit is inserted in the main apparatus body with the convex section of the process unit facing the insertion side. As the process unit is inserted, it is guided towards the engagement section by the guidance section by contact between the convex section and the main apparatus body. The process unit (case) is then located in position in the width direction thereof by engagement of the convex section and the engagement section.

(10) In this process unit, the guidance section may be inclined in the width direction. Thus the convex section can be guided in the width direction by this guidance section.

(11) In this process unit, a straight section may be provided that extends in the insertion direction in a manner capable of making contact with the engagement section on the convex section. In this way, reliable engagement of the convex section and engagement section can be achieved, so the process unit can be precisely located in position in the width direction, and subsequent positional offset thereof in the width direction can be prevented.

(12) In this process unit, the case may be erected in a condition placed on a placement surface with the exposed image carrier directed downwards from the case and there may be provided two or more feet such that the image carrier does not interfere with the placement surface, at least one of these feet serving as the convex section. Consequently, since the feet also play the role of the convex section for positional location of the process unit, there is no need to provide a separate convex section, thereby simplifying the construction and reducing manufacturing costs.

BRIEF DESCRIPTION OF THE DRAWINGS

The above and other objects, features and advantages of the present invention will become more apparent from the following detailed description taken with the accompanying drawings in which:

FIG. 13 is a table showing the values of the width dimension in each of process units A1 to A4;

DESCRIPTION OF THE PREFERRED EMBODIMENT(s)

First of all, before describing the present invention, prior art relating to the present invention and problems thereof will be described with reference to the drawings.

Figure 1A:
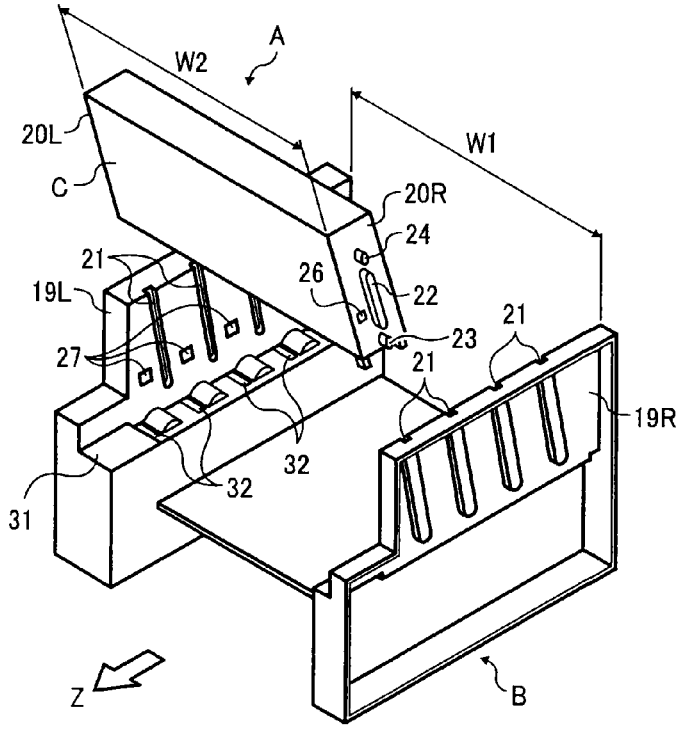
FIGS. 1A and 1B are perspective views of the main body of the apparatus with part of the image forming apparatus removed, and the process unit, seen from respectively different directions.
Figure 1B:
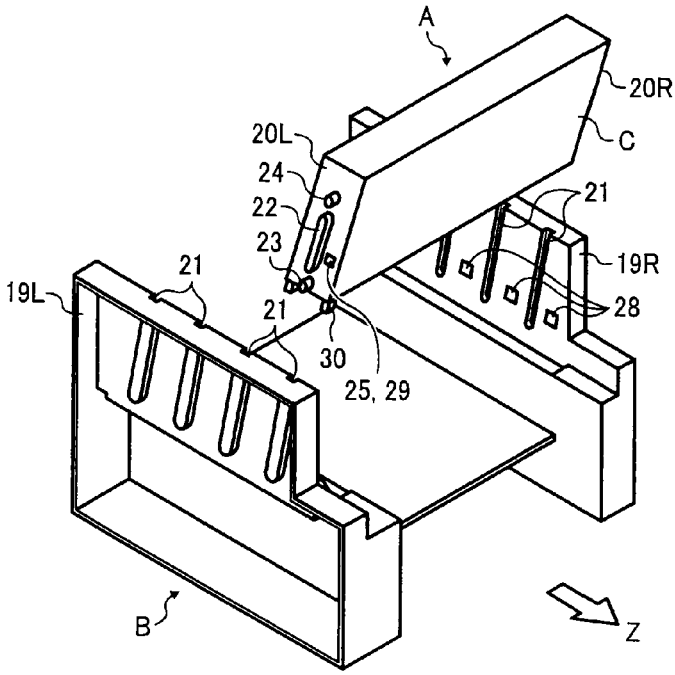

FIGS. 1A and 1B show an example of a mounting/detachment mechanism for a process unit as described above. As shown in this Figure, guide grooves 21 corresponding to the process units A of each color are formed extending in the vertical direction on the inside faces of side plates 19R, 19L arranged with prescribed gaps within the main body of the image forming apparatus B. The process units A are mounted by insertion into these guide grooves 21 from above of position locating projections 23, 24 and ribs 22 that project from the side faces 20R, 20L of the process units A and dropping the process units A to prescribed positions therein. It should be noted that in FIGS. 1A and 1B the cover at the front and rear and the top of the main body B of the apparatus and the paper feed tray etc are not shown.

Also, a plurality of electrodes 25, 26 serving for example for toner information communication or power supply are provided exposed to the outside on both side faces 20R, 20L of the case C of the process units A. Electrodes 27, 28 are also provided on the side plates 19R, 19L of the main apparatus body B, corresponding to these electrodes 25, 26. Thus, in a condition in which the process unit A is located in position in the vertical direction by insertion into the main apparatus body B as described above, the electrodes 25, 26 of the process unit A and the electrodes 27, 28 of the main apparatus body B are in contact.

Also, proposals have been made for positional location by pressing the process unit using a pressing section that is linked with a lever, in order to arrange the developing device in a prescribed position with respect to the image carrier: one such proposal is to be found in Laid-open Japanese Patent Application No. 2001-272838, referred to above.

Typically, a certain degree of movement in the width direction of the process unit is permitted by forming the dimension of the interval between the side plates larger than the width of the process unit, in order to improve ease of mounting/detachment of the process unit.

Figure 2:
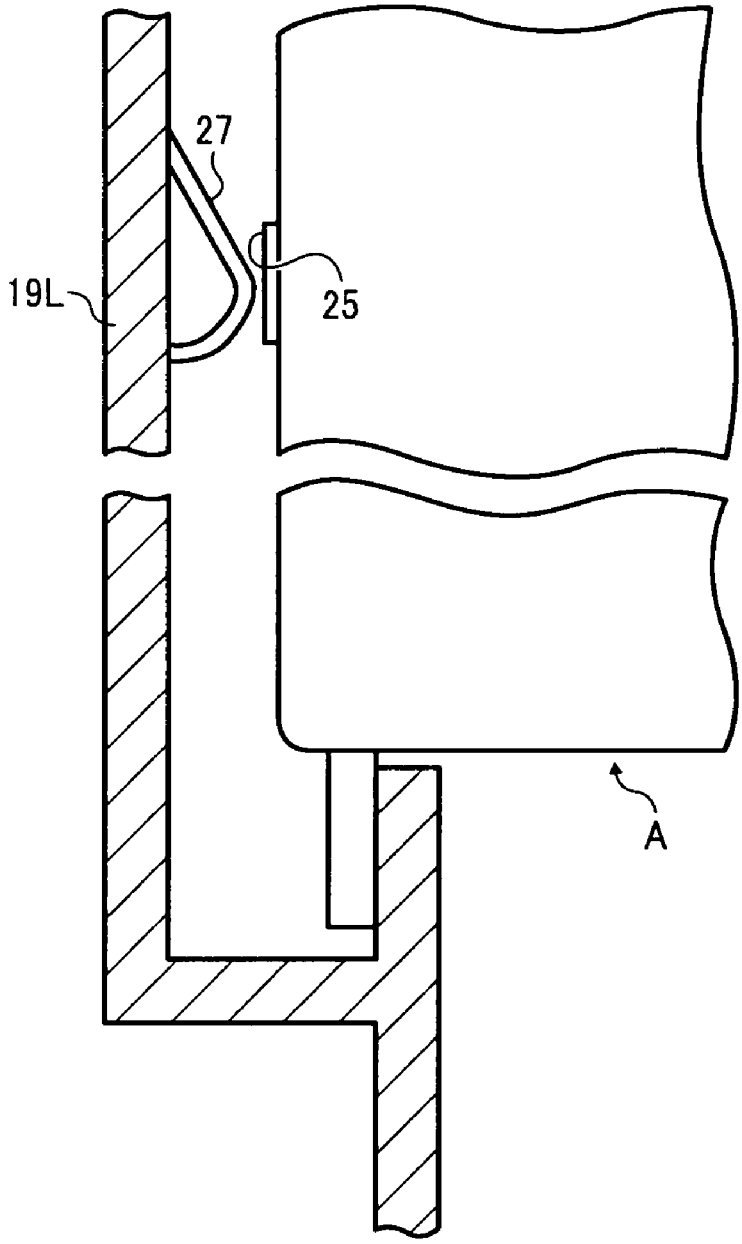
FIG. 2 is a view showing the mounted condition of a process unit on the main body of a conventional image forming apparatus.

However, if mounting of the process unit is conducted in a manner that is offset to one side in the width direction, as shown in FIG. 2, there is a possibility that contact may not be made between the electrodes 25, 27 of the process unit A and the side plate 19L, or of poor contact due for example to the correct contacting pressure not being applied. Malfunction or generation of abnormal images may occur due to communication errors or failure to apply the correct bias to the developing device, as a result of such poor contact.

In order to prevent such offset mounting of process units, it has been proposed to bring the electrodes into contact by applying pressure to the process unit by the biasing force of a resilient member.

However, since this construction also is not a construction in which the process unit can be reliably located in a prescribed position in the width direction, depending on the manner in which the user performs mounting of the unit, there is a risk that the process unit may not be mounted in the prescribed position.

Also, the mounting/detachment mechanism of the above previous proposals is subject to the problems of being complicated in construction and so inferior in regard to ease of operation and involving an increase in the number of components, which leads to increased costs.

The invention is further described in detail below with reference to the appended drawings.

Figure 3:
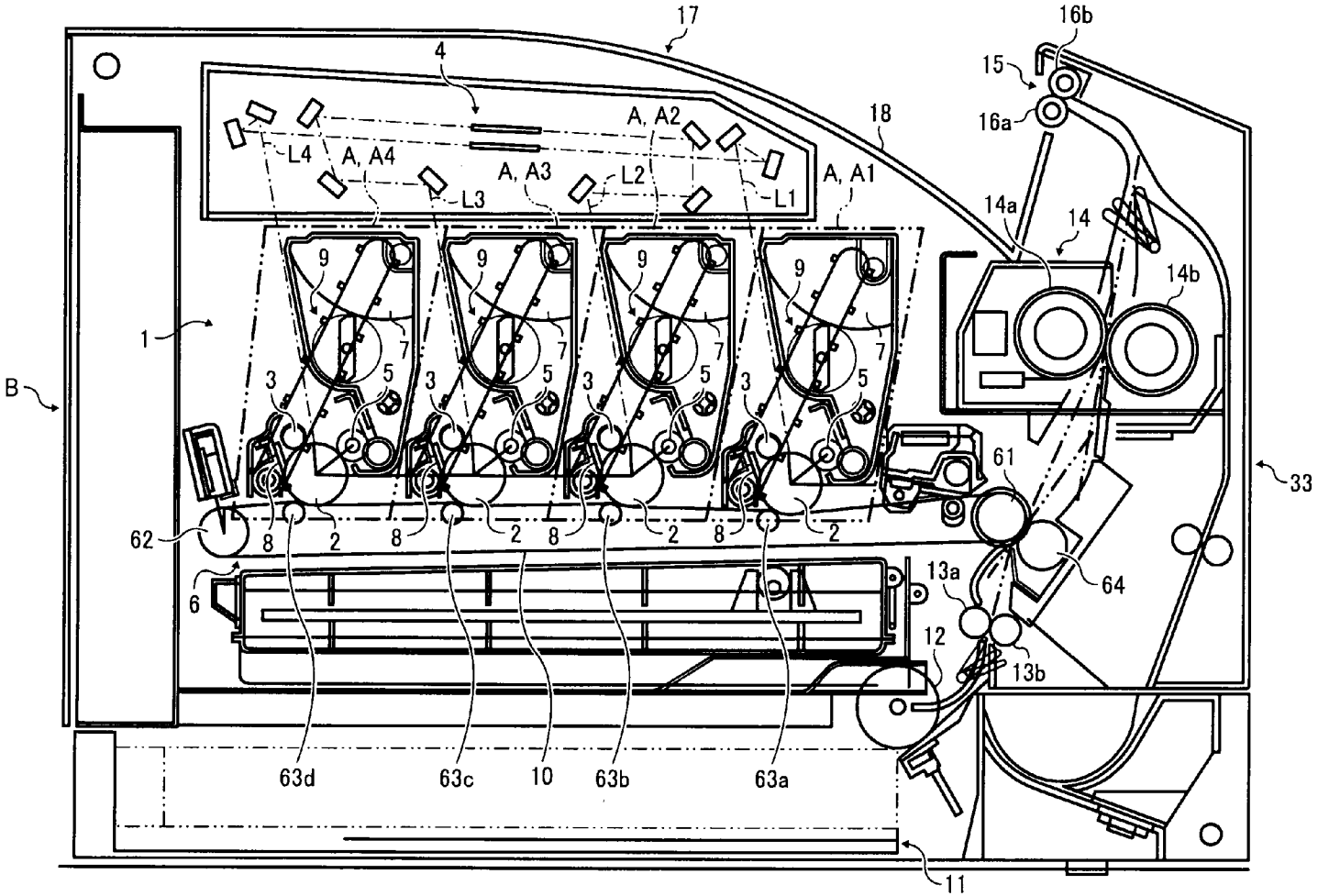
FIG. 3 is a cross-sectional view showing diagrammatically the construction of an image forming apparatus according to the present invention.

FIG. 3 shows the diagrammatic construction of a color image forming apparatus constituting an image forming apparatus according to the present invention. The main parts of this image forming apparatus are described below with reference to the drawings. The image forming apparatus comprises an image forming unit 1 that forms an image using developer of each of the colors yellow, magenta, cyan and black, corresponding to the color decomposition components of the color image.

The chief constituent elements of this image forming unit 1 are: an image carrier 2 (photosensitive body drum); a charging unit 3 that charges up the surface of the image carrier 2; an exposure device 4 that exposes the surface of the image carrier 2; a developing device 5 that forms a toner image on the surface of the image carrier 2; and a transfer device 6 that transfers this toner image to paper.

Of the various members referred to above constituting the image forming unit 1, the image carrier 2, charging unit 3 and developing device 5 are accommodated in a case as an image forming unit, and four process units A (first process unit A1 to fourth process unit A4) that are freely mountable/detachable with respect to the main image forming apparatus body B are provided, corresponding to the colors of the color image. Also, within each process unit A, there are provided for example a toner accommodating unit 7 that accommodates unused toner and used toner, a cleaning blade 8 that removes toner left on the surface of the image carrier 2, and toner conveying means 9 that conveys spent toner that has been removed to the toner accommodating unit 7.

The transfer device 6 comprises four primary transfer rollers 63*a*, 63*b*, 63*c* and 63*d* facing respective image carriers 2, an intermediate transfer belt 10 that runs in circulating fashion over the primary transfer rollers 63*a*, 63*b*, 63*c* and 63*d*, drive rollers 61 and following roller 62, and a secondary transfer roller 64 arranged facing the drive roller 61.

At the bottom of the image forming apparatus, there are provided a paper feed cassette 11 that is capable of accommodating a large number of sheets of paper, and a paper feed roller 12 that delivers paper from the paper feed cassette 11. Between the paper feed roller 12 and the secondary transfer roller 64, there are arranged a pair of resist rollers 13*a*, 13*b* at which the paper is temporarily halted. A fixing device 14 for heating and fixing the toner image formed on the paper is provided at the image forming unit 1 on the downstream side of the direction of paper feed of the secondary transfer roller 64.

Also, at the paper discharge port 15 formed at the top of the image forming apparatus, there are provided a pair of paper discharge rollers 16*a*, 16*b* constituting means for discharging paper. A paper discharge tray 18 constituted by recessing inwardly part of the top cover 17 of the main image forming device body is provided below the paper discharge port 15.

Figure 4:
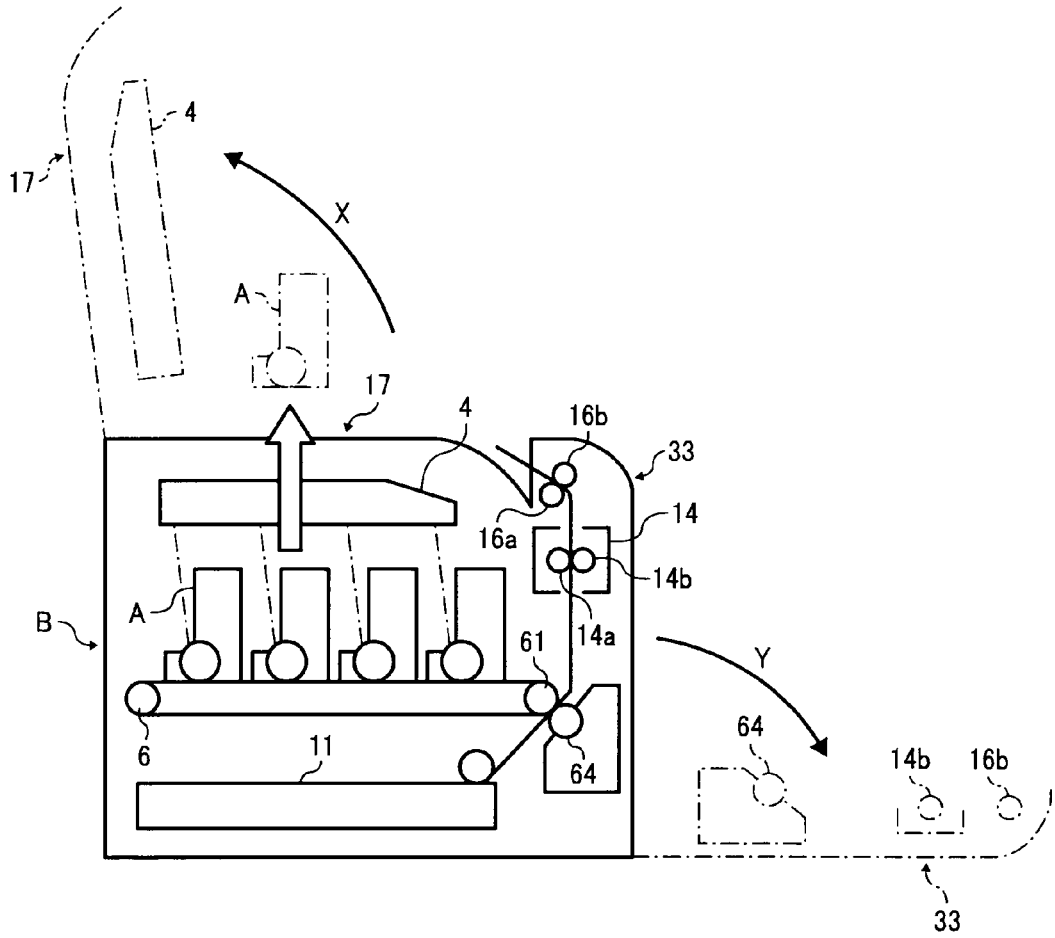
FIG. 4 is a diagram given in explanation of the opening/closing action of the top cover and front cover of the above image forming apparatus.

As shown in FIG. 4, the top cover 17 is constructed so as to be freely opened or closed by pivoting in the direction of the arrow X about a pivoting axis at the rear end thereof. Also, an exposure device 4 is supported on the bottom face (inside face) of the top cover 17: this exposure device 4 is so constructed that it can be retracted from directly above the process unit A or set in position directly above the process unit A concurrently with the opening/closure of the top cover 17.

A front cover 33 that is provided at the front of the main apparatus body B is constructed so as to be freely opened or closed by pivoting in the direction of the arrow Y about a pivoting axis at the bottom end thereof. When the front cover 33 is opened, the drive roller 61, secondary transfer roller 64, heating roller 14*a* and pressing roller 14*b* of the fixing unit 14, and the pair of paper discharge rollers 16*a*, 16*b* can easily be separated, making it possible to easily remove paper that has become jammed in the conveying path.

FIGS. 1A and 1B show the condition in which the process unit A and the main image forming apparatus body B are viewed from a different direction, with the direction indicated by the arrow Z at the front. It should be noted that, in this Figure, the front and rear and top cover of the main apparatus body B, the paper feed cassette and the transfer device etc are not shown.

As shown in FIGS. 1A and 1B, the main apparatus body B comprises a pair of left and right side plates 19R, 19L that are arranged vertically with a prescribed separation therebetween. The process unit A has a flat case C that is elongate in the width direction and the axis of the image carrier, not shown, extends in the width direction of the case C. The interval dimension W1 between the two side plates 19R and 19L is set corresponding to the width W2 of the case C of the process unit A but the interval dimension W1 of the two plates 19R, 19L is set to be larger than the width W2 of the case C.

On the mutually facing inside faces of the side plates 19R, 19L, there are formed in each case four guide grooves 21 (or guide slits) extending in the vertical direction: a rib 22 and first position locating projection 23 and second position locating projection 24 that are capable of being inserted in these guide grooves 21 are provided on both left and right side faces 20R, 20L of the process cassettes A (i.e. of case C). The width of the guide grooves 21 is set to be larger than the respective widths of the rib 22 and the first position locating projection 23 and second position locating projection 24 (see FIG. 5).

An IC chip 29 constituting an information storage circuit and a communication electrode 25 that is electrically connected with this IC chip 29 are provided exposed to the outside on the left side face 20L of the process unit A. Also, a paper feed electrode 26 is arranged exposed to the outside on the right side face 20R of the process unit A.

Also, on the inside face of the left side plate 19L of the main apparatus body B, there are arranged four communication electrodes 27 capable of connection with the communication electrode 25 of each of the process units A; these communication electrodes 27 are electrically connected with a control unit, not shown. Information communication is performed between an IC chip 29 and the above control unit through the respective communication electrodes 25, 27 of the process units A and the main apparatus body B. Also, on the inside face of the right plates 19R, there are arranged four electricity supply electrodes 28 capable of contacting the electricity supply electrodes 26 of each of the process units A. The construction is such that high voltage is applied to the charging unit 3 and developing device 5 in the process units A through the respective electricity supply electrodes 26, 28 of the process units A and the main apparatus body B. The communication electrodes 27 and electricity supply electrodes 28 that are arranged on the two side plates 19R, 19L are formed by for example metal wires or plate springs so as to be capable of being resiliently biased inwardly in the width direction. Also, the communication electrodes 25 and the electricity supply electrodes 26 of the process units A may be constituted so as to be capable of being resiliently biased respectively outwardly in the width direction.

Figure 6:
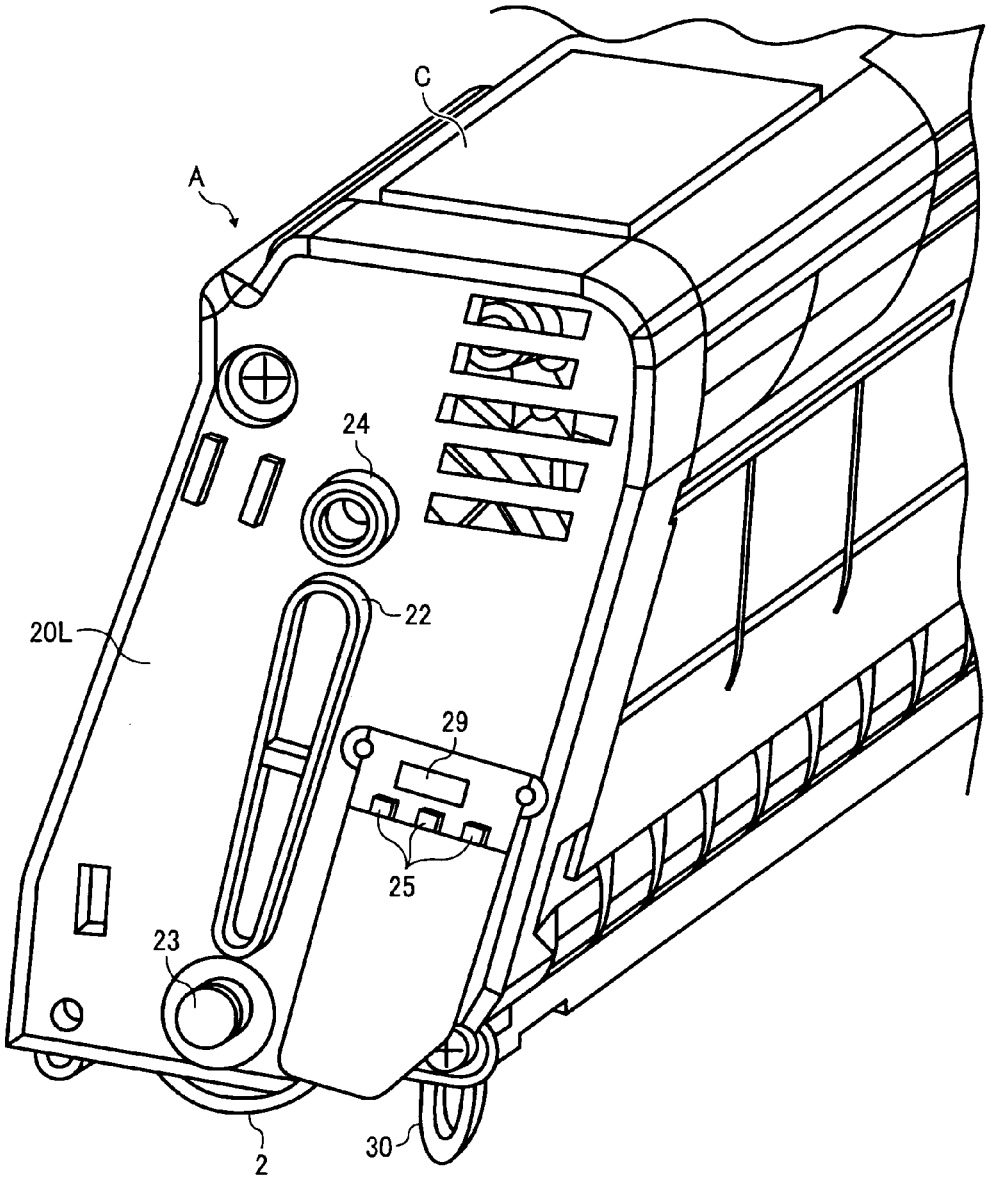
FIG. 6 is a perspective view showing the left end of the process unit.

FIG. 6 shows the left end of a process unit A. As shown in FIG. 6, on the left side face 20L of the process unit A, there are provided the rib 22, the first positional location projection 23, second positional location projection 24, IC chip 29 and a plurality of communication electrodes 25. The IC chip 29 stores information such as the ID number of the unit, the date of manufacture of the unit, and the color of the toner that is accommodated therein.

The first positional location projection 23 constitutes a rotary shaft of the image carrier 2 projecting outwardly through the left side face 20L. The first positional location projection 23 is in the vicinity of the bottom end of the left side face 20L and projects to an intermediate position in the thickness direction (forward/rearwards direction) of the case C.

The second positional location projection 24 is on the top side of the left side face 20L and projects to an intermediate position in the thickness direction (forward/rearwards direction) of the case C. Also, the rib 22 is formed in the shape of a rail that extends between the vicinity of the first positional location projection 23 and the vicinity of the second positional location projection 24. Also, regarding the first positional location projection 23, the second positional location projection 24 and the rib 22 that are provided on the right side face 20R, not shown, these are of identical construction with those of the left side face 20L, so further description thereof is dispensed with.

As shown in FIGS. 1B and 6, a downwardly projecting convex section 30 is provided at the left end side of the bottom face of the case C. Also, as shown in FIG. 1A, four insertion holes 32 capable of insertion therein of this convex section 30 are provided on the upper face of a step section 31 that protrudes inwards from the left side plate 19L.

Figure 7:
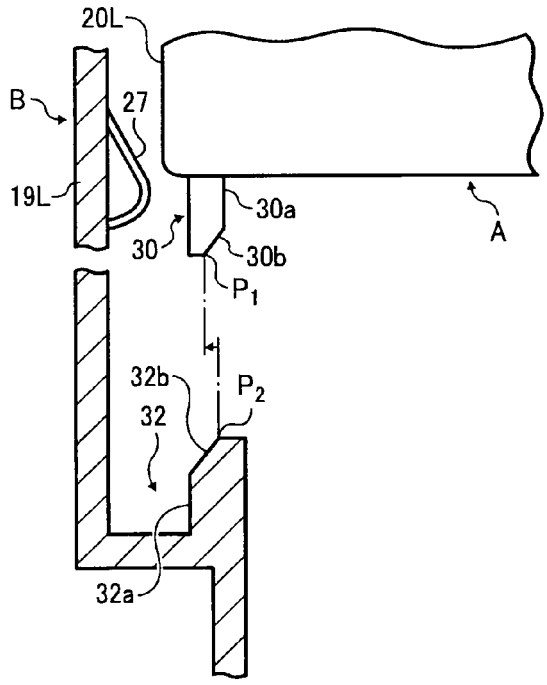
FIG. 7 is a view showing a first embodiment of the above main body of the apparatus and the process unit.

FIG. 7 shows the first embodiment of the present invention and shows the left end of the process unit A and the main apparatus body B. As shown in this Figure, in the insertion hole 32, there is provided an engagement section 32*a* that engages with the convex section 30 of the process unit A; in this case, the engagement section 32*a* is formed on a straight section that extends in the vertical direction facing the left side plate 19L. The top of the engagement section 32*a* is linked with a guidance section 32*b* that is inclined towards the left side plate 19L (in other words, approaches the left side plate 19L more closely, going downwards), and the top end of this guidance section 32*b* reaches the aperture of the insertion hole 32.

Also, on the convex section 30 of the process unit A, there is provided a straight section 30*a* extending in the vertical direction facing the opposite side to the left side plate 19L; the bottom of this straight section 30*a* is linked with a guidance section 30*b* that is inclined on the side of the left side plate 19L facing the opposite side to the left side plate 19L (in other words, approaches the left side plate 19L more closely, going downwards). Also, the bottom end of this guidance section 30*b* reaches the tip of the convex section 30.

Figure 8:
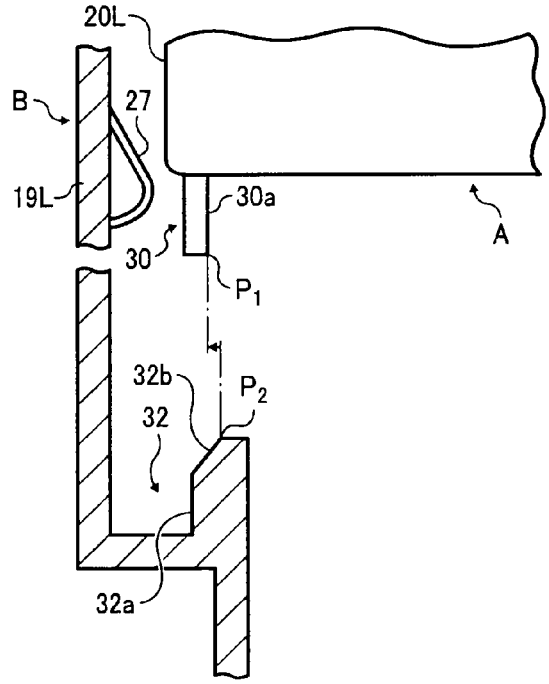
FIG. 8 is a view showing a second embodiment of the above main body of the apparatus and the process unit.

FIG. 8 shows a second embodiment of the present invention. In this case, the straight section 30*a* that extends in the vertical direction facing the opposite side to the left side plate 19L is formed at the convex section 30 of the process, unit A, reaching its tip. In other words, no inclined guidance section 30*b* as in FIG. 7 is formed. Also, a straight section 32*a* and guidance section 32*b* are provided in the same way as in the case of FIG. 7 in the insertion hole 32.

Figure 9:
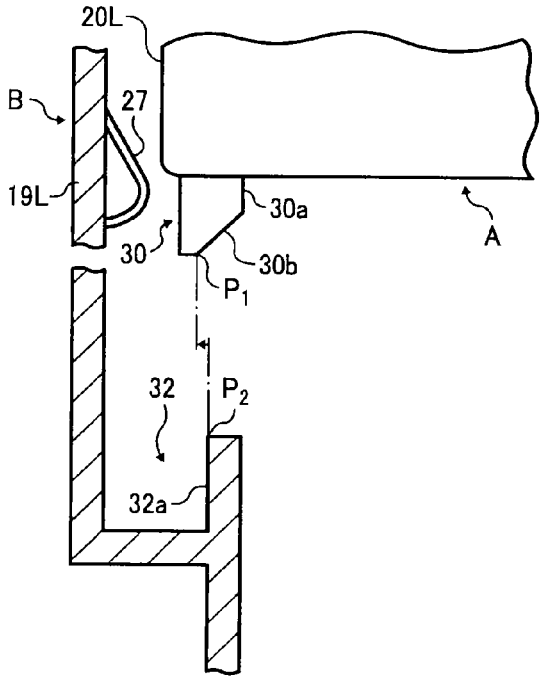
FIG. 9 is a view showing a third embodiment of the above main body of the apparatus and the process unit.

FIG. 9 shows a third embodiment of the present invention. In this embodiment, in the insertion hole 32, there is performed an engagement section 32*a* (straight section) that extends in the vertical direction facing the left side plate 19L, reaching the aperture thereof: no inclined guidance section 32*b* as in FIG. 7 is formed. Also, a straight section 30*a* and guidance section 30*b* are provided on the convex section 30, in the same way as in the case of FIG. 7.

In FIGS. 7 to 9, even in the case where the process unit A is offset to the maximum (whether approaching this or in contact therewith) towards the right side plate, not shown, between the two side plates, the bottom end $P_1$ of the guidance section 32*b* of the convex section 30 or the bottom end $P_1$ of the straight section 30*a* with no guidance section 30*b* is arranged more separated with respect to the left side plate 19L than the top end $P_2$ of the guidance section 32*b* of the insertion hole 32 or the top end $P_2$ of the straight section 32*a* with no guidance section 32*b*, such that the convex portion 30 is guided to the engagement section 32*a* by the guiding section.

Figure 10:
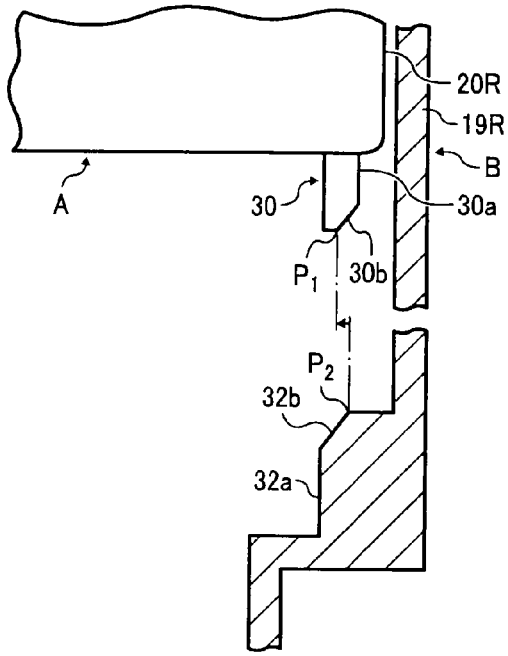
FIG. 10 is a view showing a fourth embodiment of the above main body of the apparatus and the process unit.

In the fourth embodiment of the present invention shown in FIG. 10, the convex section 30 is arranged projecting at the bottom face of the right-hand side of the process unit A and a guidance section 32*b* that guides the projection 30 and an engagement section 32*a* (straight section) extending in the vertical direction for engagement with the convex section 30 may be provided on the right side plate 19R. This guidance section 32*b* is inclined on the side of the left side plate facing the left side plate, not shown (in other words, it approaches the left side plate, going downwards). Also, the convex section 30 is provided with a straight section 30*a* extending in the vertical direction and a guidance section 30*b* inclined on the side of the left side plate, facing the right side plate 19R (in other words, it approaches the left side plate, going downwards). In the case where the process unit A is offset to the maximum (whether approaching this or in contact therewith) towards the right side plate 19R, between the two side plates, the bottom end $P_1$ of the guidance section 30*b* of the convex section 30 is arranged more separated with respect to the left side than the top end $P_2$ of the guidance section 32*b* of the right side plate 19R.

Also, a convex section 30 may be provided at both the left and right ends of the process unit A and an engagement section 32*a* may be provided on both the side plates 19R, 19L engaging with these convex sections 30. The guidance section 30*b* provided on the convex section 30 and the guidance section 32*b* provided in the insertion hole 32 may be formed in convex curved face shape or concave curved face shape, apart from being formed in planar shape (straight face shape).

Also, the straight section extending in the vertical direction may be provided on at least one of the convex section 30 or main apparatus body B.

Figure 5:
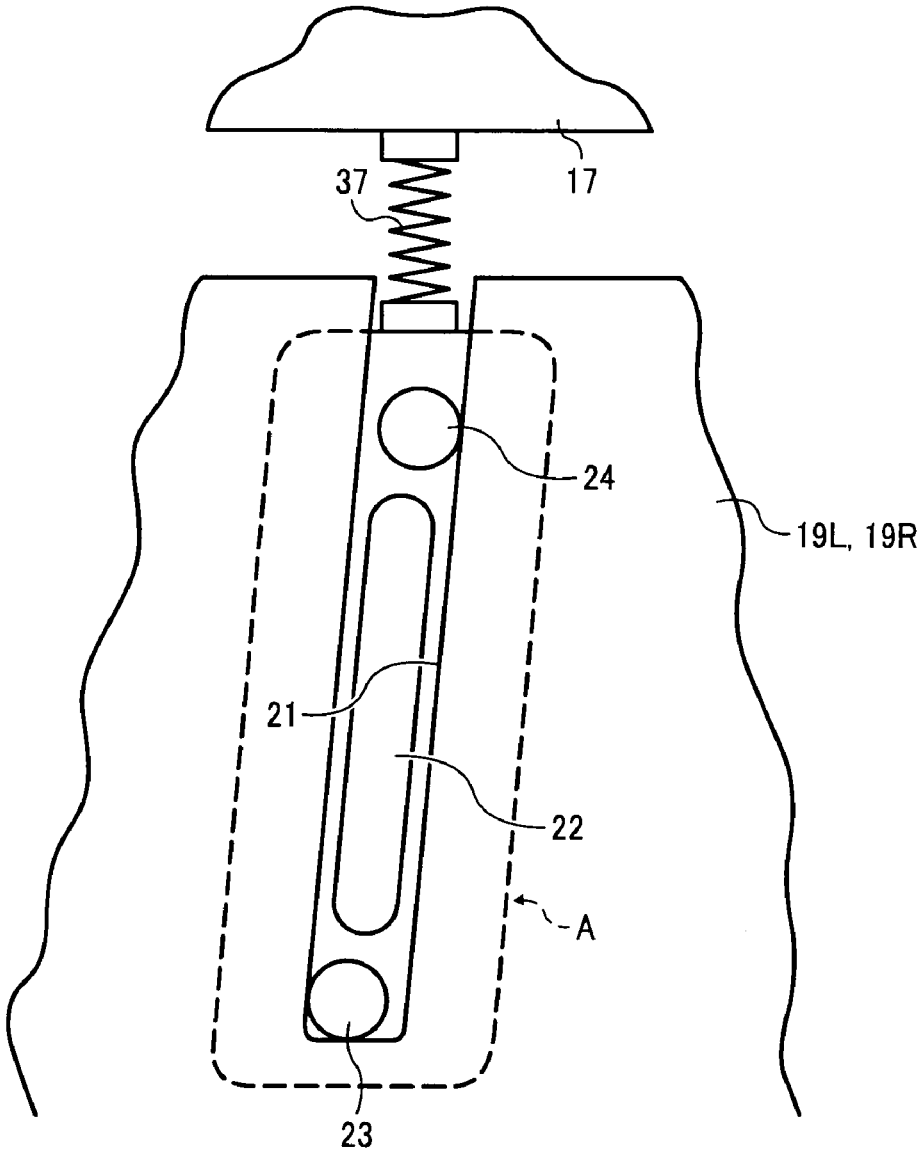
FIG. 5 is a diagram showing the condition in which the top cover of the above main body of the apparatus is closed.
Figure 11:
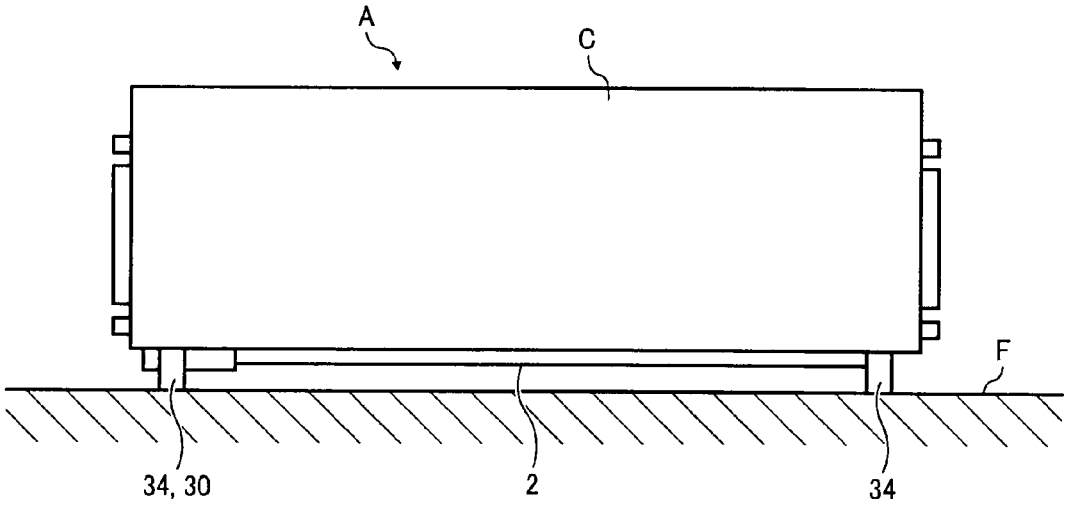
FIG. 11 is a front view showing the condition in which the above process unit is placed on a placement surface.

FIG. 11 shows the condition in which the process unit A is moved from the main apparatus body and placed on a placement surface F such as the floor or a desk. As shown in this Figure, when the portion of the image carrier 2 is exposed from the case C, this exposed portion is placed directed downwards in order to avoid degradation of the exposed portion of the image carrier 2 by external light. A plurality of feet 34 project from the undersurface of the case C to prevent the image carrier 2 from coming into contact with the placement surface F. The process unit A may be constructed so as to stand independently on the placement surface F, by means of this plurality of feet 34. If the feet 34 are narrow feet of pin shape, there are preferably at least three of these; if they are wider, so that their area of contact with the placement surface F is broader, there are preferably at least two. The tips of the feet 34 project from the exposed portion of the image carrier 2 that is exposed from the undersurface of the case C. Also, of the plurality of feet 34, at least one foot 34 may comprise a convex section 30 that engages with the engagement section 32*a* of the main apparatus body B and is formed with a guidance section 30*b* inclined as shown in FIG. 5 and/or a straight section 30*a*.

Figure 12A:
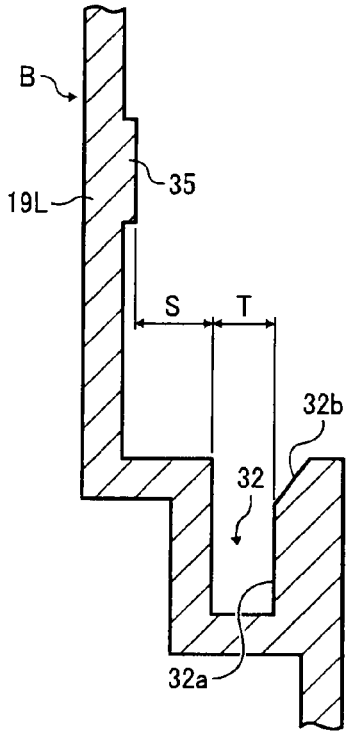
FIGS. 12A and 12B are views showing a fifth embodiment of the above main body of the apparatus and the process unit.
Figure 12B:
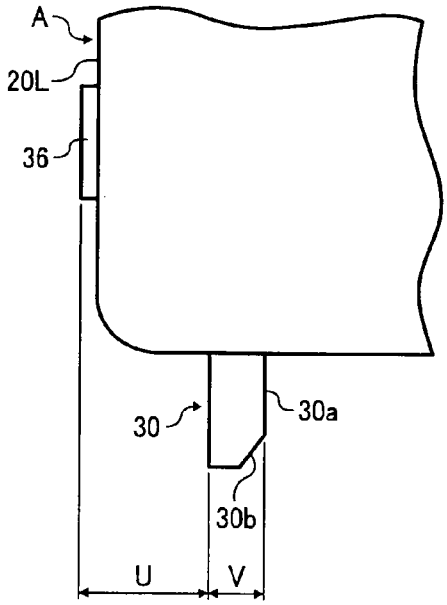

As shown in FIGS. 12A and 12B, in a fifth embodiment of the present invention, an interference section 35 projects on the inside face of the left side plate 19L and an interference section 36 projects also on the left side face 20L of the process unit A. The width dimension S from the tip of the interference section 35 that is provided on the left side plate 19L to the insertion hole 32 and the width dimension U of the tip of the interference section 36 of the process unit A to the convex section 30 may be set to different values for each of the four process units A (A1 to A4).

Specifically, the above width dimensions S and U and the width dimension T of the insertion hole 32 and the width dimension V of the concave section 30 may be set as shown in FIG. 13. The units are centimeters. It should be noted that the values of the width dimensions of FIG. 13 merely represent one example and other dimensions could be employed, in which the difference between the dimensions S and U and the difference between the dimensions T and V are equal. The differences (0.5, 1) themselves could be altered in value, being increased or decreased.

Figure 14:
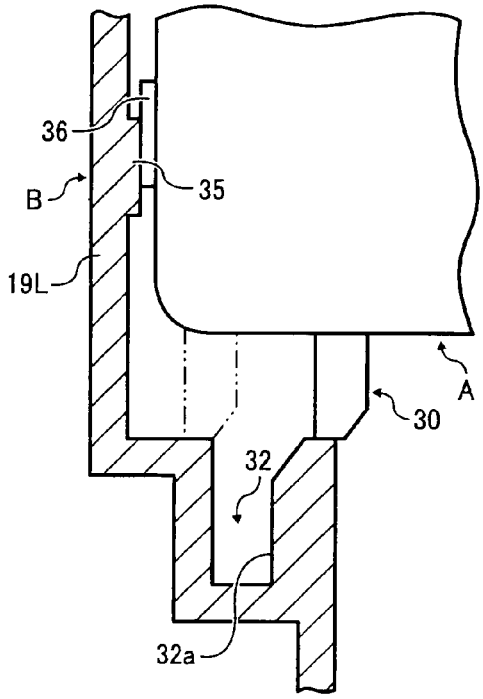
FIG. 14 is a view showing a condition in which the above process unit is wrongly mounted in the above main body of the apparatus.

By setting the width dimensions as in FIG. 13, mounting of the process units A1 to A4 in positions other than the prescribed mounting positions can be prevented. For example, if a process unit A of larger width dimension U than the width dimension U of the process unit A corresponding to the width dimension S on the side of the main apparatus body B is attempted to be mounted, as shown in FIG. 14, the interference section 36 of the process unit A abuts the interference section 35 of the left side plate 19L, so the convex section 30 cannot approach as far as the engagement section 32*a* of the insertion hole 32. Also, if a process unit A of smaller width dimension U than the width dimension U of the process unit A corresponding to the width dimension S on the side of the main apparatus body B is attempted to be mounted, the convex section 30 approaches too close to the left side plate 19L due to interference of the right end, not shown, of the process unit A and the right side plate, with the result that this process unit A cannot be inserted in the insertion hole 32 (see the double dotted chain line of FIG. 14). Wrong mounting of the various process units can thereby be prevented.

Also in order to prevent wrong mounting of the various process units, the cross-sectional shape of the convex section 30 may be made of different shape for each of the process units A1 to A4 and the cross-sectional shape of each of the insertion hole 32 may be formed corresponding to the cross-sectional shape of the convex section 30 that is inserted therein. Also, the cross-sectional shape of the interference section 36 may be made different for each of the process units A1 to A4 and the cross-sectional shapes of the interference sections 35 of the left side plate 19L may be formed corresponding to the cross-sectional shape of these interference sections 36.

It should be noted that the above width dimension S and width dimension U may be adjusted by changing the amount of projection of the respective interference sections 35, 36. It is also possible to adjust the width dimension S and width dimension U by changing the position of arrangement of the insertion hole 32 and the position of arrangement of the convex section 30 in the width direction. Also, the interference sections 35, 36 may be provided on either of the left side plate 19L and the process unit A, or a construction may be adopted in which interference sections 35, 36 are provided on neither of these, but the left side plate 19L and the left side face 20L of the process unit A are arranged to come into direct abutment.

The basic operation of this image forming apparatus is described below.

In FIG. 3, when the paper feed roller 12 is rotated in response to a paper feed signal from the control section of the image forming apparatus, not shown, only the sheet of paper at the uppermost position of the stack of paper in the paper feed cassette 11 is separated and fed to the resist roller pair 13*a*, 13*b* which are downstream. When the tip of the paper reaches the nip of the resist roller pair 13*a*, 13*b*, it waits to achieve synchronization with the timing of the toner image formed by the image forming section 1.

Next, the image formation operation will be described. First of all, the surface of the image carrier 2 is charged up to a uniform high potential by the charging unit 3. Next, the surface of the image carrier 2 is illuminated with a laser beam (L1 to L4) from the exposure device 4 under the control of the image data, thereby forming an electrostatic latent image by lowering of the potential in the illuminated portions. Toner images of the various colors are formed (developed) by transferring toner from the developing device 5 onto surface portions of the image carriers 2 where this electrostatic latent image is formed. The toner images of the various colors on the image carriers 2 are then transferred to the intermediate transfer belt 10 so as to overlap.

Drive of the resist roller pair 13*a*, 13*b* and the paper feed roller 12 is then recommenced and paper is fed to the secondary transfer rollers 64 synchronized with the timing of the toner image obtained by overlapping transfer onto the intermediate transfer belt 10. The overlapping transferred toner image is then transferred to the paper that is fed thereto, by means of the secondary transfer roller 64. After this, the paper onto which the toner image has been transferred is conveyed to the fixing device 14, where heat fixing of the toner image onto the paper is effected before the paper is discharged to the paper discharge tray 18 from the paper discharge port 15 which is at the top of the main image forming apparatus body.

Also, toner remaining on the surface of the image carriers 2 after completion of the transfer process is scraped off by a cleaning blade 8 and the used toner that has thus been scraped off is delivered to a used toner recovery section within the toner accommodation section 7 by toner conveying means 9, and stored.

Mounting of the process units in the image forming apparatus will now be described.

First of all, as shown in FIG. 4, the upper cover 17 is pivoted in the direction of the arrow X, to put it in an open condition. Next, as shown in FIGS. 1A and 1B, the first positional location projections 23 provided on the left and right side faces 20R, 20L of the process unit A, rib 22, and second positional locating projection 24 are successively inserted from above into the guide grooves 21, 21 of the left and right side plates 19R, 19L of the main apparatus body B with the face provided with the convex section 30 of the process unit A facing downwards. The process unit A drops downwards with the first positional location projection 23, rib 22 and second positional location projection 24 sliding along the guide groove 21.

Figure 15:
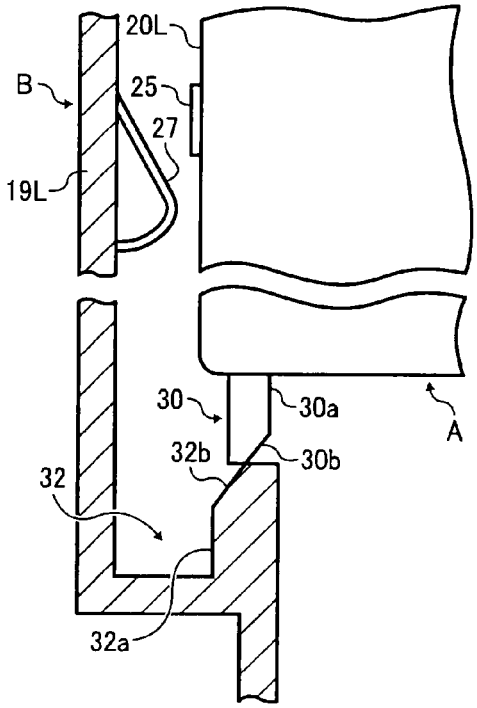
FIG. 15 is a view showing how the above process unit is mounted in the above main body of the apparatus.
Figure 16:
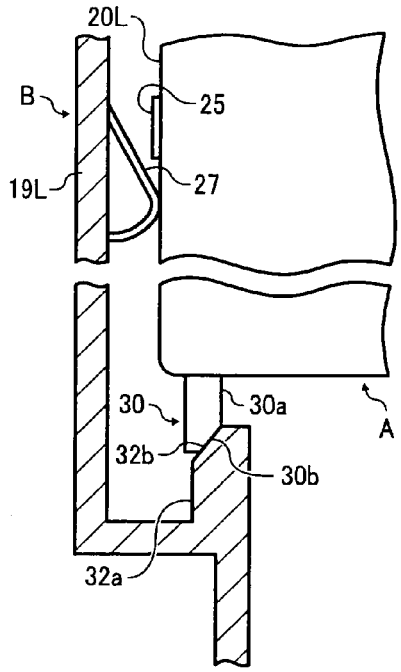
FIG. 16 is a view showing how the above process unit is mounted in the above main body of the apparatus.

With the down-dropping movement of the process unit A, the convex section 30 of the process unit A approaches the insertion hole 32 provided in the main apparatus body B, so that, as shown in FIG. 15, the guide section 30*b* of the convex section 30 comes into abutment with the guidance section 32*b* provided on the main apparatus body B. Then, as shown in FIG. 16, the convex section 30 slides along the guidance section 32*b* of the main apparatus body B, and, with this sliding movement, the left side face 20L of the process unit A approaches the left side plate 19L.

Figure 17:
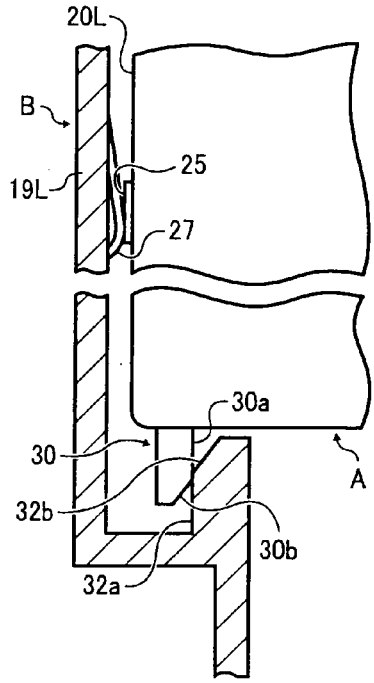
FIG. 17 is a view showing how the above process unit is mounted in the above main body of the apparatus.

With further down-dropping movement of the process unit A, as shown in FIG. 17, the communication electrode 25 of the process unit A comes into contact with the communication electrode 27 of the main apparatus body B and is pressed onto the left side plate 19L with resilient deformation thereof. Then, when the convex section 30 has finished passing through the guidance section 32*b* of the main apparatus body B, the concave section 30 drops downwards and the straight section 30*a* of the concave section 30 and the straight section 32*a* of the main apparatus body B are located in position in the width direction with face contact or line contact.

Also, during the process of descent of the process unit A, the power supply electrode 26 on the right side face of the process unit A makes contact (see FIGS. 1A and 1B) with the power supply electrode 28 provided on the right side plate. Also, by the respective restoring forces of the communication electrode 27 and power supply electrode 28 of the elastically deformed main apparatus body B, contact can be reliably effected with the communication electrode 25 and power supply electrode 26 of the process unit A.

After this, as shown in FIG. 5, the first position locating projection 23, constituted by the rotary shaft of the image carrier 2, is located in position in the vertical direction of the process unit A by abutment with the bottom end of the guide groove 21. By thus making the rotary shaft of the image carrier 2 abut the bottom end of the guide groove 21, positional location of the image carrier 2 in the vertical direction can be performed with high precision. Also, when the top cover 17, which was previously in the open condition, is closed, the process unit A is pressed downwards by a resilient member 37 such as a spring provided on the inside face of the top cover 17, with the result that the second positional location projection 24 is located in position in a position (upper position) different from that of the first positional location projection 23, by contact with the inside wall of the guide groove 21. In this way, correction of the attitude of the process unit A as a whole is achieved.

Also, since the mounting of the process unit of the embodiment of FIGS. 8 to 10 is performed by the same method as the method of mounting described above, a description thereof is omitted.

Embodiments of the present invention have been described above. Although, in the embodiments described above, the description has been given with reference to the example of a process unit comprising an image carrier, charging unit, developing device and toner accommodating unit a process unit comprising at least one of these members could be employed. Alternatively, a process unit could be employed having a member other than these members. Also, although, in the embodiments described above, the process unit was moved towards the left by the guidance section, a construction could be employed in which the process unit is moved towards the right. Also, in FIGS. 1A and 1B, apart from forming the engagement section 32*a* on the inside face of the insertion hole 32, a projection could be provided on the upper surface of a step 31 (see FIG. 1A) of the main apparatus body B, an engagement section being provided on the wall surface thereof.

With an image forming apparatus and process unit according to the present invention, the process unit can be reliably located in position in the width direction. In this way, the various members provided in the process unit can be arranged in correct positions with respect to the various members that are provided on the main apparatus body, thereby making it possible to improve the quality of the image that is produced. Also, since the process unit can be located in position in the width direction by a straightforward construction, there is no possibility of ease of mounting/detachment of the process unit being adversely affected. A further merit is that manufacturing costs can be kept low.

Various modifications will become possible for those skilled in the art after receiving the teachings of the present disclosure without departing from the scope thereof.

What is claimed is:

1. In an image forming apparatus comprising:

a main apparatus body;

a process unit including at least one of an image carrier, a charging unit, a developing device and a toner accommodating unit, the process unit is detachably mounted to the main apparatus body in an insertion direction orthogonal to a width direction of the process unit, which is a vertical direction of the main apparatus body;

a convex section of the process unit that projects from a bottom side of the process unit;

an engagement section of a top side of the main apparatus body that positions the process unit in the width direction by engaging with the convex section if the process unit is mounted to the main apparatus body and the top side of the main apparatus body faces the bottom side of the process unit in the insertion direction; and a guidance section that guides the convex section towards the engagement section, if the process unit is mounted, the guidance section being on at least one of a tip end of the convex section and the main apparatus body, wherein the convex section and the engagement section each include a straight section that extends in the insertion direction and contact between the straight section of the convex section and the straight section of the engagement section positions the process unit in the width direction.

2. The image forming apparatus as claimed in claim 1, wherein the guidance section is inclined in the width direction.

3. The image forming apparatus as claimed in claim 1, wherein the process unit includes an image carrier that is exposed outside of the process unit, an exposed section of the image carrier is directed downwards toward the bottom side of the process unit, the process unit includes two or more feet so that the image carrier does not interfere with a placement surface on which the process unit is placed, and at least one of the feet is the convex section.

4. The image forming apparatus as claimed in claim 1, further comprising:

a plurality of process units that accommodate toners of different colors, wherein the process units include an interference section whereby interference of the respective process unit and the main apparatus body occurs if an attempt is made to insert the process units in a position other than a prescribed mounting position.

5. An image forming apparatus comprising:

a main apparatus body;

a process unit including at least one of an image carrier, a charging unit, a developing device and a toner accommodating unit, the process unit is detachably mounted to the apparatus main body in an insertion direction orthogonal to a width direction of this process unit, which is a vertical direction of the main apparatus body;

a convex section of the process unit that projects from a bottom side of the process unit;

an engagement section of a top side of the main apparatus body that positions the process unit in the width direction by engaging with the convex section if the process unit is mounted and the top side of the main apparatus body faces the bottom side of the process unit in the insertion direction;

a guidance section that guides the convex section towards the engagement section, if the process unit is mounted, the guidance section being on at least one of a tip end of the convex section and the main apparatus body;

a pair of side plates, that face each other with a gap corresponding to the width direction of the process unit, arranged in the main apparatus body, the process unit being detachably mounted between the pair of side plates;

electrodes that mutually contact arranged in one side face of the process unit and in the side plate corresponding to the one side face; and a guidance section of the main apparatus body that is inclined to the one side plate side, wherein the convex section and the engagement section each include a straight section that extends in the insertion direction and contact between the straight section of the convex section and the straight section of the engagement section positions the process unit in the width direction.

6. The image forming apparatus as claimed in claim 5, wherein the guidance section is on the convex section and the guidance section is inclined to the one side plate side.

7. The image forming apparatus as claimed in claim 5, wherein the electrodes are arranged to biased in an inwards direction of the one side plate.

8. The image forming apparatus as claimed in claim 5, wherein the process unit includes an image carrier that is exposed outside of the process unit, an exposed section of the image carrier is directed downwards toward the bottom side of the process unit, the process unit includes two or more feet so that the image carrier does not interfere with a placement surface on which the process unit is placed, and at least one of the feet is the convex section.

9. The image forming apparatus as claimed in claim 5, further comprising;

a plurality of process units that accommodate toners of different colors, wherein the process units include an interference section whereby interference of the respective process unit and the main apparatus body occurs if an attempt is made to insert the process units in a position other than a prescribed mounting position.

10. A process unit comprising:

a case that accommodates at least one of an image carrier, a charging unit, a developing device, and a toner accommodating unit, the case is detachably mounted to a main apparatus body of an image forming apparatus in an insertion direction orthogonal to a width direction of the case, which is a vertical direction of the case;

a convex section that projects from a bottom side of the case, wherein an engagement section of the main apparatus body positions the case in the width direction by engaging with the convex section if the case is mounted, a guidance section that guides the convex section towards the engagement section if the case is mounted, the guidance section is on at least one of a tip end of the convex section and the main apparatus body, and the convex section and the engagement section each include a straight section that extends in the insertion direction and contact between the straight section of the convex section and the straight section of the engagement section positions the case in the width direction.

11. The process unit as claimed in claim 10, wherein the guidance section is inclined in the width direction.

12. The process unit as claimed in claim 10, further comprising:

two or more feet provided such that the image carrier does not interfere with a placement surface if the case is placed on the placement surface with the image carrier exposed from the case in a downwards direction, wherein at least one of these feet is the convex section.

* * * * *